US011092292B2

(12) United States Patent
Peyron et al.

(10) Patent No.: US 11,092,292 B2
(45) Date of Patent: Aug. 17, 2021

(54) METHOD FOR REHEATING AN ATMOSPHERIC VAPORIZER USING A GAS ORIGINATING FROM A CRYOGENIC AIR SEPARATION UNIT

(71) Applicant: L'Air Liquide, Societe Anonyme pour l'Etude et l'Exploitation des Procedes Georges Claude, Paris (FR)

(72) Inventors: Jean-Marc Peyron, Creteil (FR); Fabrice Rivoal, Vitry sur Seine (FR); Lian-Ming Sun, Villebon-sur-Yvette (FR)

(73) Assignee: L'Air Liquide Societe Anonyme Pour L'Etude Et L'Exploitation Des Procedes Georges Claude, Paris (FR)

( * ) Notice: Subject to any disclaimer, the term of this patent is extended or adjusted under 35 U.S.C. 154(b) by 0 days.

(21) Appl. No.: 16/797,764

(22) Filed: Feb. 21, 2020

(65) Prior Publication Data

US 2020/0191334 A1 Jun. 18, 2020

Related U.S. Application Data

(63) Continuation of application No. 15/861,803, filed on Jan. 4, 2018, now Pat. No. 10,605,410.

(30) Foreign Application Priority Data

Jan. 5, 2017 (FR) ..... FR 1750088

(51) Int. Cl.

| | |
|---|---|
| ***F17C 9/02*** | (2006.01) |
| ***F17C 13/10*** | (2006.01) |
| ***F25J 3/04*** | (2006.01) |

(52) U.S. Cl.

CPC ..... *F17C 13/10* (2013.01); *F17C 9/02* (2013.01); *F25J 3/04412* (2013.01); (Continued)

(58) Field of Classification Search

CPC ..... F17C 9/02; F17C 13/10; F17C 2225/00; F17C 2225/0115; F17C 2225/0123; F17C 2227/0311; F17C 2227/0313; F17C 2227/0393; F25J 3/04; F25J 3/04612; F25B 47/006; F25B 47/022

See application file for complete search history.

(56) References Cited

U.S. PATENT DOCUMENTS

2011/0192194 A1* 8/2011 Howard ..... F25J 3/04236 62/644

FOREIGN PATENT DOCUMENTS

DE 40 25 138 2/1992
DE 4025138 A1 * 2/1992 ..... F25J 3/04824
(Continued)

OTHER PUBLICATIONS

French Search Report and Written Opinion for FR 1 750 088, dated Sep. 20, 2017.

*Primary Examiner* — Frantz F Jules
*Assistant Examiner* — Erik Mendoza-Wilkenfeld
(74) *Attorney, Agent, or Firm* — Justin K. Murray

(57) ABSTRACT

In a method for reheating an atmospheric vaporizer, a cryogenic liquid is vaporized by heat exchange with ambient air in the atmospheric vaporizer and to reheat the vaporizer, a gas is sent thereto at a temperature of at least 0° C., this gas originating from a cryogenic distillation air separation unit.

8 Claims, 1 Drawing Sheet

(52) U.S. Cl.
CPC ... *F25J 3/04824* (2013.01); *F17C 2223/0161* (2013.01); *F17C 2227/0311* (2013.01); *F17C 2227/0393* (2013.01); *F17C 2260/032* (2013.01); *F25J 2245/40* (2013.01); *F25J 2245/42* (2013.01); *F25J 2245/50* (2013.01); *F25J 2245/58* (2013.01); *F25J 2250/42* (2013.01); *F25J 2250/50* (2013.01); *F25J 2250/58* (2013.01)

(56) References Cited

FOREIGN PATENT DOCUMENTS

| | | |
|---|---|---|
| EP | 0 795 614 | 9/1997 |
| EP | 1 903 290 | 3/2008 |
| FR | 2 906 878 | 4/2008 |
| GB | 2 143 022 | 1/1985 |
| JP | 2005 351 579 | 12/2005 |

* cited by examiner

METHOD FOR REHEATING AN ATMOSPHERIC VAPORIZER USING A GAS ORIGINATING FROM A CRYOGENIC AIR SEPARATION UNIT

CROSS REFERENCE TO RELATED APPLICATIONS

The present application is a continuation application of U.S. application Ser. No. 15/861,803, filed Jan. 4, 2018, which claims the benefit of priority under 35 U.S.C. § 119 (a) and (b) to French patent application No. FR1750088, filed Jan. 5, 2017, by which the contents of both are incorporated herein by reference in their entireties.

FIELD OF THE INVENTION

The present invention relates to a method for reheating an atmospheric vaporizer using a gas originating from a cryogenic air separation unit.

BACKGROUND

In a cryogenic air separation unit (ASU), a backup system may be necessary to supply a gaseous product, for example oxygen, nitrogen or argon, in case of shutdown of the ASU for a limited period. The backup system is generally composed of a cryogenic liquid storage and a liquid vaporization system.

Different vaporization systems can be used depending on the atmospheric conditions, on the production capacity, etc. (e.g. an exchanger with a heat transfer fluid such as steam or water, a vaporizer of pool type heated by steam, an atmospheric vaporizer, etc.).

An atmospheric vaporization system constitutes an economical option and offers the advantage of using the "free" heat while it is in service. However, its main drawback is that it has a limited service time because of the icing on the outer surface of the vaporizer because of the presence of moisture in the air.

The de-icing of an atmospheric vaporizer can be done naturally if the temperature of the air is hot enough, for example above 0° C. However, if the ambient temperature may remain cold for a long period (for example a few weeks or even a few months), the installation of a heating system for the de-icing of the vaporizer may prove necessary.

The conventional de-icing methods consist in installing either a dedicated reheater (generally electrical) in line or an electrical reheater outside of the vaporizer but within a closed enclosure, combined with forced ventilation. These de-icing means present a significant cost overhead and, in the case of an in-line electrical reheater for an oxygen vaporizer, there is also a potential risk of high temperature oxygen fire.

SUMMARY OF THE INVENTION

In certain embodiments of the invention, solutions are proposed that are more economical and easier to implement, which do not require any dedicated reheater installation.

According to one object of the invention, a method for reheating, even de-icing, an atmospheric vaporizer is provided in which:

i) in normal operation, a cryogenic liquid having as its main component oxygen, nitrogen or argon originating from a source is vapourized by heat exchange with the ambient air in the atmospheric vaporizer and in which ii) in reheating phase, to reheat, even de-ice the vaporizer, the cryogenic liquid is no longer sent from the source to the atmospheric vaporizer but, instead, a gas is sent thereto at a temperature of at least 0° C., preferably of at least 20° C., this gas originating from a cryogenic distillation air separation unit, the gas being either a) a stream of air purified of water and of carbon dioxide taken from the air supply of the air separation unit or b) a gas originating from a column of the air separation unit reheated in a heat exchanger by the air intended for the distillation.

According to other optional aspects of the invention:

- the gas has the same main component as the cryogenic liquid.
- the gas at a temperature of at least 0° C. and the cryogenic liquid contain at least 70% mol of oxygen, even at least 90% mol of oxygen.
- the gas at a temperature of at least 0° C. and the cryogenic liquid contain at least 85% mol of nitrogen, even at least 90% mol of nitrogen.
- the gas at a temperature of at least 0° C. and the cryogenic liquid contain at least 85% mol of argon, even at least 90% mol of argon.
- according to the variant b) the gas originating from a column of the unit is divided into two parts, a first part being sent into the atmospheric vaporizer and a second part being expanded but not being sent into the atmospheric vaporizer, the expanded second part being mixed with the first part downstream of the atmospheric vaporizer.
- according to the variant ii), the gas originating from the column is pressurized upstream of the atmospheric vaporizer.
- the cryogenic liquid originates from the air separation unit.
- the gas originating from the air separation unit sent to the vaporizer in reheating phase is at a temperature of at least 50° C.
- during the reheating, the atmospheric temperature is not greater than 0° C.
- preferably, electrical means are not used to heat the vaporizer in reheating phase.

The method can make it possible to operate an atmospheric vaporizer intended to supply gas for a limited period, in care of failure of an ASU.

In some cases, the gas is supplied during a programmed shutdown of the air separation unit.

In other cases, when the ambient temperature is below zero, the atmospheric vaporizer is covered with ice and cannot be used until the ambient temperature rises sufficiently. In this case, a means of de-icing the vaporizer has to be found.

The design and the dimensioning of the atmospheric vaporizer must guarantee the supply of the gas for a predefined period before the bulk formation of ice.

BRIEF DESCRIPTION OF THE DRAWINGS

These and other features, aspects, and advantages of the present invention will become better understood with regard to the following description, claims, and accompanying drawing(s). It is to be noted, however, that the drawing(s) illustrate only several embodiments of the invention and are therefore not to be considered limiting of the invention's scope as it can admit to other equally effective embodiments.

DETAILED DESCRIPTION OF THE INVENTION

The method according to the invention will be described in more detail with reference to the figures.

Figure 1:
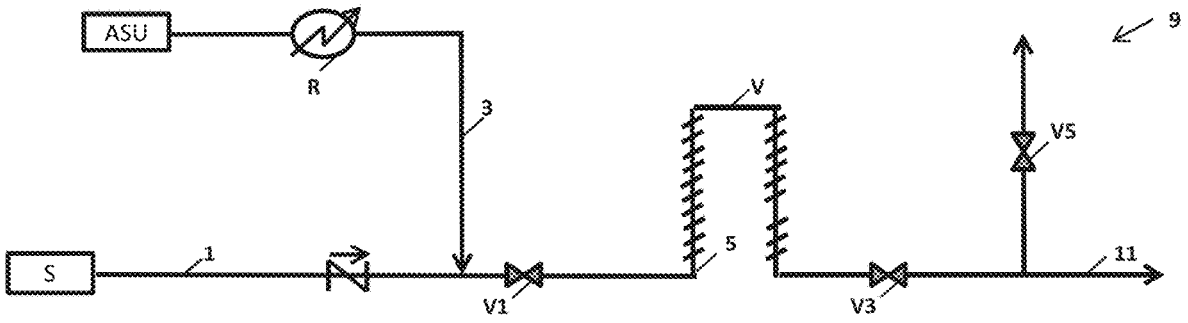
FIG. 1 shows an embodiment of the invention.

FIG. 1 shows the method for reheating an atmospheric vaporizer by using air originating from an air separation unit.

In normal operation, a cryogenic liquid 1 having as its main component oxygen, nitrogen or argon is withdrawn from a storage S. The liquid is sent through a valve V1 to a vaporizer V by a duct 5. The liquid is vaporized in the vaporizer by heat exchange with the air and the gas formed is sent through the valve V3 to a duct 11 by which it supplies a client.

In the case where the vaporizer is covered with ice, it is necessary to heat the vaporizer V and, for this, the sending of the liquid 1 to the vaporizer is stopped.

In normal operation, air is sent to an air separation unit ASU where it is purified of water and of carbon dioxide in a purification unit. At the output of the purification unit, it is cooled and sent to a distillation column to be separated.

When the vaporizer V has to be reheated, at the output of the purification unit, the air is divided into two parts. A first part is cooled and sent to a distillation column to be separated. A second part 3 is heated to at least 0° C., maybe to at least 20° C., and preferably to at least 50° C. in a reheater R, for example an electrical reheater or steam reheater.

This air is sent to the atmosphere by the valve V3, V5 and the duct 9 after having circulated in the vaporizer V to reheat it.

The main drawback with this solution is the need to restore the content of the vaporizers V after the de-icing operation.

Figure 2:
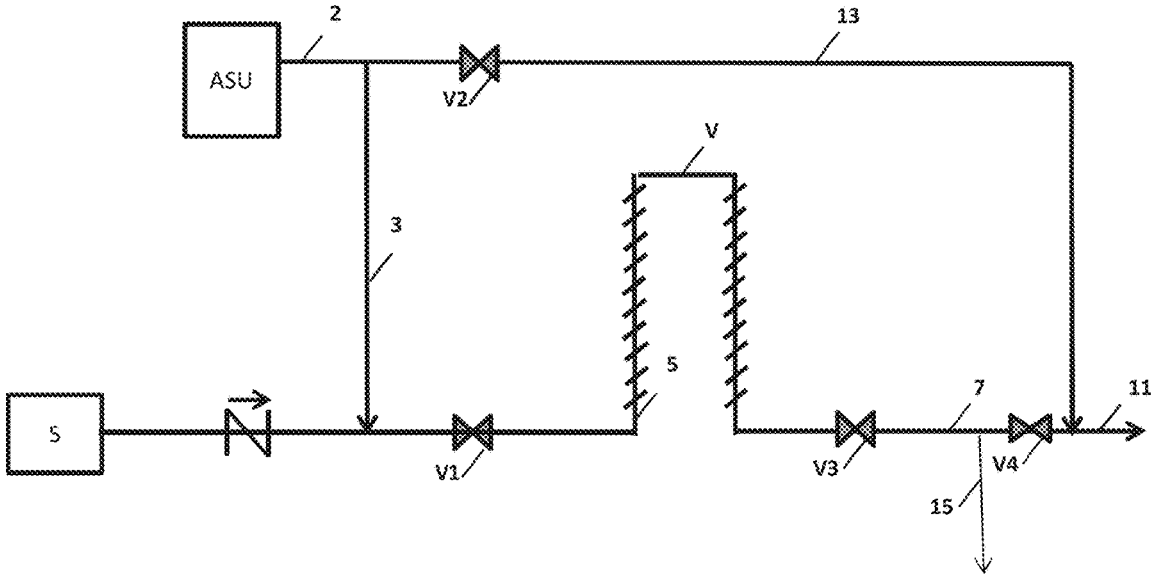
FIG. 2 shows an embodiment of the invention.

According to the method of FIG. 2, the reheating of the vaporizer is performed with a gas produced by distillation in the air separation unit ASU, preferably having the same main component as the cryogenic liquid.

In normal operation, a cryogenic liquid 1 having as its main component oxygen, nitrogen or argon is withdrawn from a storage S. The liquid is sent through a valve V1 to a vaporizer V by a duct 5. The liquid is vaporized in the vaporizer by heat exchange with the air and the gas formed is sent through the valve V3 to a duct 11 by which it supplies a client.

In the case where the vaporizer is covered with ice, it is necessary to heat the vaporizer V and, for this, the sending of the liquid 1 to the vaporizer is stopped.

In normal operation, air is sent to an air separation unit ASU where it is purified of water and of carbon dioxide in a purification unit. At the output of the purification unit, it is cooled and sent to a distillation column to be separated to form a gas having as its main component oxygen, nitrogen or argon 2. The gas is either output from a distillation column in gaseous form and reheated in a heat exchanger where the air supply is cooled or output from a distillation column in liquid form and vapourized and reheated in a heat exchanger where the air supply is cooled. In this way, it is at a minimum temperature of 0° C. in most cases.

When the vaporizer V has to be reheated, at the output of the purification unit, at least a part of the gas 3 is sent to the vaporizer to reheat it and preferably de-ice it, possibly after reheating in a reheater (not illustrated). If the main component of the gas 3 and that of the liquid 1 are the same, the gas 3 can be sent to the client by the duct 11. Otherwise, it can be rejected to the atmosphere.

In a particular case illustrated in FIG. 2, the gas 2 is divided into two parts 3, 13. A first part at at least 0° C., perhaps at at least 20° C., preferably at at least 50° C. is sent to reheat the vaporizer V. The gas 3 may if necessary be reheated upstream of the vaporizer V. The second part of the gas 13 is expanded in a valve V2 and is mixed with the gas 3 that was used for the reheating of V downstream of the valve V3. Thus, the two parts 3, 13 are sent to the client by the duct 11.

A valve V4 can be closed in order to send the gas which was used for the reheating to the air via the duct 15. In this case, it is possible to reheat, even de-ice, the vaporizer V and to vent the reheating gas, even de-icing gas, to the atmosphere, while a part of the production 13 is sent to the client.

Once the de-icing is done, normal operation of the method is resumed.

The main advantages of this solution are:

that the product is not lost during the de-icing period, that the restoration of content is not necessary, unlike the solution of FIG. 1 presented above.

The main drawback is the need to increase the pressure of the gas produced in order to compensate for the headloss of the vaporizers. This may prove difficult when the gas is produced at low pressure, for example nitrogen originating from the low-pressure column of a double column. In this case, the solution of FIG. 1 should be prioritized.

In the case of the two figures, the storage S can be supplied from the air separation unit ASU or not.

The reheating gas 3 can be used in addition to a reheater.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a nonexclusive listing (i.e., anything else may be additionally included and remain within the scope of "comprising"). "Comprising" as used herein may be replaced by the more limited transitional terms "consisting essentially of" and "consisting of" unless otherwise indicated herein.

"Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

All references identified herein are each hereby incorporated by reference into this application in their entireties, as well as for the specific information for which each is cited.

The invention claimed is:

1. A method for reheating, even de-icing, an atmospheric vaporizer in which:

i) in a normal operation, vaporizing a cryogenic liquid originating from a source by heat exchange with ambient air in the atmospheric vaporizer, wherein the cryogenic liquid has a main component of oxygen, nitrogen or argon; and ii) in a reheating phase, no longer sending the cryogenic liquid from the source to the atmospheric vaporizer but, instead, sending a gas to the atmospheric vaporizer at a temperature of at least 0° C., wherein said gas originates from a cryogenic distillation air separation unit, wherein the gas sent to the atmospheric vaporizer in the reheating phase is a stream of air purified of water and of carbon dioxide taken from the air supply of the cryogenic distillation air separation unit.

2. The method according to claim 1, in which the source of the cryogenic liquid is the cryogenic distillation air separation unit.

3. The method according to claim 1, in which the main component of the cryogenic liquid is oxygen.

4. The method according to claim 1, in which the gas sent to the atmospheric vaporizer in reheating phase is at a temperature of at least 20° C.

5. The method according to claim 1, in which the gas sent to the atmospheric vaporizer in reheating phase is at a temperature of at least 50° C.

6. The method according to claim 1, in which the gas sent to the atmospheric vaporizer in the reheating phase provides sufficient heat to de-ice the atmospheric vaporizer.

7. The method according to claim 1, in which, during the reheating phase, the atmospheric temperature is not greater than 0° C.

8. The method according to claim 1, further comprising an absence of using electrical means to heat the atmospheric vaporizer in the reheating phase.

* * * * *